US009441310B2

(12) United States Patent
Suzuki et al.

(10) Patent No.: US 9,441,310 B2
(45) **Date of Patent: *Sep. 13, 2016**

(54) TIN-PLATED STEEL SHEET AND METHOD FOR MANUFACTURING THE SAME

(71) Applicant: JFE Steel Corporation, Tokyo (JP)

(72) Inventors: Takeshi Suzuki, Tokyo (JP); Norihiko Nakamura, Tokyo (JP); Hiroki Iwasa, Tokyo (JP)

(73) Assignee: JFE Steel Corporation (JP)

( * ) Notice: Subject to any disclaimer, the term of this patent is extended or adjusted under 35 U.S.C. 154(b) by 154 days.

This patent is subject to a terminal disclaimer.

(21) Appl. No.: 14/132,090

(22) Filed: Dec. 18, 2013

(65) Prior Publication Data

US 2014/0102907 A1 Apr. 17, 2014

Related U.S. Application Data

(62) Division of application No. 13/003,091, filed as application No. PCT/JP2009/062493 on Jul. 2, 2009, now abandoned.

(30) Foreign Application Priority Data

Jul. 10, 2008 (JP) ..... 2008-179680

(51) Int. Cl.

| | |
|---|---|
| ***C25D 5/10*** | (2006.01) |
| ***C23C 2/08*** | (2006.01) |
| ***C23C 2/26*** | (2006.01) |
| ***C23C 2/28*** | (2006.01) |
| ***C23C 22/08*** | (2006.01) |
| ***C23C 22/20*** | (2006.01) |
| ***C23C 22/73*** | (2006.01) |
| ***C23C 28/00*** | (2006.01) |
| ***C25D 3/30*** | (2006.01) |
| ***C25D 5/48*** | (2006.01) |
| ***C25D 11/36*** | (2006.01) |

(52) U.S. Cl.

CPC . *C25D 5/10* (2013.01); *C23C 2/08* (2013.01); *C23C 2/26* (2013.01); *C23C 2/28* (2013.01); *C23C 22/08* (2013.01); *C23C 22/20* (2013.01); *C23C 22/73* (2013.01); *C23C 28/321* (2013.01); *C23C 28/322* (2013.01); *C23C 28/34* (2013.01); *C25D 3/30* (2013.01); *C25D 5/48* (2013.01); *C25D 11/36* (2013.01)

(58) Field of Classification Search

CPC ..... C23C 22/08; C23C 22/73; C23C 2/08; C25D 3/30; C25D 5/10

USPC ..... 205/170

See application file for complete search history.

(56) References Cited

U.S. PATENT DOCUMENTS 3,912,601 A * 10/1975 Asano et al. ..... 205/318
4,306,917 A 12/1981 Oda et al.

FOREIGN PATENT DOCUMENTS

| | | | |
|---|---|---|---|
| EP | 1 243 688 | A1 | 9/2002 |
| EP | 1 518 944 | A1 | 3/2005 |
| EP | 1 942 208 | A1 | 7/2008 |
| JP | 49-028539 | A | 3/1974 |
| JP | 55-024516 | B | 6/1980 |
| JP | 56-096081 | A | 8/1981 |
| JP | 59-047396 | A | 3/1984 |
| JP | 2005-029808 | A | 2/2005 |
| JP | 2007-239091 | A | 9/2007 |
| JP | 2007239091 | A * | 9/2007 |

* cited by examiner

*Primary Examiner* — Weiping Zhu

(74) *Attorney, Agent, or Firm* — DLA Piper LLP (US)

(57) ABSTRACT

A method of manufacturing a tin-plated steel sheet includes forming an Sn-containing plating layer on at least one surface of a steel sheet so that the mass per unit area of Sn is 0.05 to 20 g/m$^2$; forming a first chemical conversion coating by immersing the steel sheet in a first chemical conversion solution containing tetravalent tin ions and phosphate ions or cathodically electrolyzing the steel sheet in the first chemical conversion solution; forming a second chemical conversion coating after forming the first chemical conversion coating without drying the steel sheet by immersing the steel sheet in a second chemical conversion solution containing 5 to 200 g/L of aluminum phosphate monobasic and having a pH of 1.5 to 2.4 or cathodically electrolyzing the steel sheet in the second chemical conversion solution; and drying the steel sheet.

5 Claims, No Drawings

TIN-PLATED STEEL SHEET AND METHOD FOR MANUFACTURING THE SAME

TECHNICAL FIELD

This disclosure relates to tin-plated steel sheets for use in DI cans, food cans, beverage cans, and the like, and particularly relates to a tin-plated steel sheet having a chemical conversion coating containing no chromium (Cr) on the surface and a method for manufacturing the same.

BACKGROUND

As surface-treated steel sheets for use in cans, tin-plated steel sheets referred to as "tinplates" have been widely used. Generally in such tin-plated steel sheets, a chromate coating is formed on the tin-plated surface of the steel sheets by chromate treatment such as immersing the steel sheet in an aqueous solution containing a hexavalent chromium compound such as dichromic acid, or electrolyzing the steel sheet in the solution. This is because, by formation of the chromate coating, oxidation of the tin-plated surface that is likely to occur due to long-term storage or the like can be prevented, and a degradation of appearance (yellowing) can be suppressed. In addition, when lacquer is applied to the tin-plated steel sheet before use, cohesive failure due to the growth of a tin (Sn) oxide layer is prevented and adhesion with organic resin such as paints, (hereinafter simply referred to as "paint adhesion") is ensured.

In contrast, considering recent environmental problems, restriction of the use of chromium has proceeded in various fields, and some chemical conversion treatment techniques in stead of the chromate treatment have been proposed also for the tin-plated steel sheets for cans.

For example, Japanese Examined Patent Application Publication No. 55-24516 discloses a method for surface-treating a tin-plated steel sheet. The method includes forming a chemical conversion coating by performing direct current electrolysis using the tin-plated steel sheet as a cathode in a phosphoric acid solution. Japanese Examined Patent Application Publication No. 58-41352 discloses a chemical conversion solution containing phosphate ions, one or more of chlorates and bromates, and tin ions and having a pH of 3 to 6. Japanese Unexamined Patent Application Publication No. 49-28539 discloses a surface treatment method, for tinplates, including applying one or more of calcium phosphates, magnesium phosphates, and aluminum phosphates so that the coating thickness is 15 $\mu g/m^2$ or lower. Japanese Unexamined Patent Application Publication No. 2005-29808 discloses a surface-treated steel sheet, for containers, successively having an iron (Fe)-nickel (Ni) diffusion layer, an Ni layer, and an Ni—Sn alloy layer, a non-alloyed Sn layer and further having 1 to 100 $mg/m^2$ of a phosphate coating layer in terms of phosphorus (P) on the steel sheet surface.

However, the chemical conversion coatings disclosed in JP '516, JP '352, JP '539 and JP '808 cannot suppress degradation of appearance or reduction in paint adhesion caused by oxidization of the tin-plated surface compared to conventional chromate coatings.

In contrast, Japanese Unexamined Patent Application Publication No. 2007-239091 discloses a method for manufacturing a tin-plated steel sheet including plating a steel sheet with tin, immersing the tin-plated steel sheet in a chemical conversion solution containing tin ions and phosphate ions or subjecting the steel sheet to cathodic electrolysis in a chemical conversion solution, and then heating the same to 60 to 200° C. to form a chemical conversion coating, thereby suppressing degradation of appearance and reduction in paint adhesion caused by oxidization of the tin-plated surface to a degree equal to or higher than the suppression degree obtained by conventional chromate coatings.

However, the method disclosed in JP '091 has a problem that a heating unit used subsequently to chemical conversion is necessary and therefore the cost of chemical conversion is high.

It could therefore be helpful to provide a tin-plated steel sheet, without using Cr, that can suppress degradation of appearance and reduction in paint adhesion caused by oxidization of the tin-plated surface and can be subjected to chemical conversion treatment at low cost and a method for manufacturing the same.

SUMMARY

We conducted extensive research on a tin-plated steel sheet, without using Cr, that can suppress degradation of appearance and reduction in paint adhesion caused by oxidization of the tin-plated surface and that can be subjected to chemical conversion treatment at low cost. We found that when a tin-plated steel sheet having a Sn-containing plating layer on the steel sheet surface, a first chemical conversion coating containing P and Sn on the Sn-containing plating layer, and a second chemical conversion coating containing P and aluminum (Al) on the first chemical conversion coating is achieved, the degradation of appearance and the reduction in paint adhesion can be suppressed without heating after the chemical conversion treatment.

We thus provide a tin-plated steel sheet including an Sn-containing plating layer in which the mass per unit area of Sn is 0.05 to 20 $g/m^2$ and which is disposed on at least one surface of the steel sheet; a first chemical conversion coating which contains P and Sn, in which the mass per unit area of P is 0.3 to 10 $mg/m^2$, and which is disposed on the Sn-containing plating layer; and a second chemical conversion coating which contains P and Al, in which the mass per unit area of P is 1.2 to 10 $mg/m^2$ and the mass per unit area of Al is 0.24 to 8.7 $mg/m^2$, and which is disposed on the first chemical conversion coating.

A tin-plated steel sheet can be manufactured by the following method: a method including forming an Sn-containing plating layer on at least one surface of a steel sheet such that the mass per unit area of Sn is 0.05 to 20 $g/m^2$, immersing the steel sheet in a chemical conversion solution containing tetravalent tin ions and phosphate ions or cathodically electrolyzing the steel sheet in the chemical conversion solution, immersing the steel sheet in a chemical conversion solution containing 5 to 200 g/L of aluminum phosphate monobasic and having a pH of 1.5 to 2.4 or cathodically electrolyzing the steel sheet in this chemical conversion solution, and then drying the steel sheet.

Drying is preferably performed at a temperature of lower than 60° C.

It is now possible to manufacture a tin-plated steel sheet, without using Cr, that can suppress degradation of appearance and reduction in paint adhesion caused by oxidization of the tin-plated surface, requires no special heating facility, and can be subjected to chemical conversion treatment at low cost. A chemical conversion coating of the tin-plated steel sheet can be formed at a high line speed of 300 m/minute or more similarly as in the case of the current chromate treatment.

DETAILED DESCRIPTION

A tin-plated steel sheet successively includes an Sn-containing plating layer, a first chemical conversion coating containing P and Sn, and a second chemical conversion coating containing P and Al on at least one surface of a general cold-rolled steel sheet for cans using low carbon steel or extremely low carbon steel. Hereinafter, the details will be described.

(1) Sn-Containing Plating Layer

First, to provide corrosion resistance, the Sn-containing plating layer is formed on at least one surface of the steel sheet. In this case, the mass per unit area of Sn needs to be 0.05 to 20 g/m$^2$. This is because when the mass per unit area of Sn is lower than 0.05 g/m$^2$, the corrosion resistance is poor and when the mass per unit area of Sn exceeds 20 g/m$^2$, the plating layer thickness increases, which causes an increase in cost. The mass per unit area of Sn can be measured by coulometry or surface analysis using fluorescence X-rays.

The Sn-containing plating layer is not particularly limited and is preferably a plating layer such as a plating layer containing an Sn layer (hereinafter referred to as "Sn layer"), a plating layer having a two-layer structure in which an Sn layer is formed on an Fe—Sn layer (hereinafter referred to as "Fe—Sn layer/Sn layer"), a plating layer having a two-layer structure in which an Sn layer is formed on Fe—Sn—Ni layer (hereinafter referred to as "Fe—Sn—Ni layer/Sn layer"), or a plating layer having a three-layer structure in which an Fe—Sn—Ni layer and an Sn layer are successively formed on an Fe—Ni layer (hereinafter referred to as "Fe—Ni layer/Fe—Sn—Ni layer/Sn layer").

The Sn-containing plating layer may be a continuous plated layer or a discontinuous layer with a dotted pattern.

The Sn-containing plating layer can be formed by a known process. For example, the Sn-containing plating layer can be formed by electroplating a steel sheet with Sn using a usual tin phenolsulfonate plating bath, tin methanesulfonate plating bath, or tin halide plating bath such that the mass per unit area is 2.8 g/m$^2$, performing reflow treatment at a temperature equal to or higher than the melting point of Sn, that is, 231.9° C., to form a plating layer of Fe—Sn layer/Sn layer, performing cathodic electrolysis at 1 to 3 A/dm$^2$ in a 10 to 15 g/L aqueous sodium carbonate solution to remove an Sn oxide film formed on the surface after the reflow treatment, and washing the steel sheet with water. The plating layer containing Ni among the above-described Sn-containing plating layers can be formed by plating a steel sheet with nickel before tin plating and, as required, performing annealing treatment or performing reflow treatment or the like after tin plating.

(2) First Chemical Conversion Coating

Next, the first chemical conversion coating, which contains P and Sn, is provided on the Sn-containing plating layer. This is because, to efficiently form a chemical conversion coating at a high line speed of 300 m/minute or more, a chemical conversion solution containing tetravalent tin ions and phosphate ions is used as described in detail below, similarly as in the current chromate treatment. In this case, the mass per unit area of P in the chemical conversion coating needs to be 0.3 to 10 mg/m$^2$. This is because, when the mass per unit area of P is lower than 0.3 mg/m$^2$, the surface coverage of the coating becomes insufficient. Thus, an effect of suppressing the oxidization of the tin-plated surface becomes insufficient and, when the mass per unit area of P exceeds 10 mg/m$^2$, the cohesive failure of the coating is likely to occur. Thus, the appearance is likely to deteriorate and the paint adhesion is likely to decrease.

The first chemical conversion coating can be formed by immersing the plated steel sheet in a chemical conversion solution containing tetravalent tin ions and phosphate ions or cathodically electrolyzing the plated steel sheet in the chemical conversion solution. The steel sheet may be washed with water after the immersion treatment or the cathodic electrolysis treatment. The reason why the chemical conversion solution containing tetravalent tin ions and phosphate ions is used is to form the chemical conversion coating at a high line speed of 300 m/minute or more as described above. More specifically, tetravalent tin ions have high solubility and a larger number of tetravalent tin ions can be added compared with the case of divalent tin ions. Moreover, since tetravalent tin ions are reduced to divalent tin ions near the tin surface by electrons emitted with the dissolution of the tin surface, high-concentration divalent tin ions are generated near the tin-plated surface, and thus a reaction is accelerated. Furthermore, when cathodic electrolysis treatment is performed, reduction of tetravalent tin ions to divalent tin ions is accelerated and also a reduction reaction of protons is also accelerated to increase the pH near the tin-plated surface to thereby promote precipitation deposition of insoluble tin (II) hydrogen phosphate or tin (II) phosphate. Thus, the reaction is further accelerated. Accordingly, when the chemical conversion solution containing tetravalent tin ions and phosphate ions is used, the chemical conversion coating is efficiently formed in a short period of time.

As the chemical conversion solution containing tetravalent tin ions and phosphate ions, an aqueous solution containing 0.5 to 5 g/L of stannic chloride pentahydrate and 1 to 80 g/L of orthophosphoric acid is mentioned.

(3) Second Chemical Conversion Coating

Finally, the second chemical conversion coating containing P and Al is provided on the above-described first chemical conversion coating. This is because when a chemical conversion coating containing P and Al is formed, degradation of appearance and reduction in paint adhesion can be suppressed to a degree equal to or higher than the suppression degree obtained by conventional chromate coatings simply by drying at low temperatures without positively heating after chemical conversion treatment. The reason is not clear, but is believed to be because a dense chemical conversion coating of phosphate having stronger barrier properties to the oxidization of the tin-plated layer is formed by introduction of Al into the chemical conversion coating. In this case, the mass per unit area of P in the chemical conversion coating needs to be 1.2 to 10 mg/m$^2$ and the mass per unit area of Al therein needs to be 0.24 to 8.7 mg/m$^2$. This is because when the mass per unit area of P is lower than 1.2 mg/m$^2$ or the mass per unit area of Al is lower than 0.24 mg/m$^2$, an effect of suppressing oxidization of the tin-plated surface becomes insufficient. Thus, the appearance deteriorates and paint adhesion decreases with time and when the mass per unit area of P exceeds 10 mg/m$^2$, the cohesive failure of the coating itself occurs. Thus, the paint adhesion is likely to decrease. The upper limit of the mass per unit area of Al of 8.7 mg/m$^2$ is a stoichiometrically derived value when the total amount of the coating is occupied by aluminum phosphate tribasic. When the mass per unit area of P is lower than 10 mg/m$^2$, the value does not exceed this value. The mass per unit area of P or the mass per unit area of Al in the chemical conversion coating can be measured by surface analysis using fluorescence X-rays.

The second chemical conversion coating can be formed by immersing the steel sheet having the first chemical conversion coating in a chemical conversion solution containing 5 to 200 g/L of aluminum phosphate monobasic and having a pH of 1.5 to 2.4 or cathodically electrolyzing the steel sheet having the first chemical conversion coating in this chemical conversion solution, and then drying the steel sheet. After the immersion or cathodic electrolysis treatments, the steel sheet may be washed with water, and then may be dried. In this case, based on the following reason, the chemical conversion solution containing 5 to 200 g/L of aluminum phosphate monobasic and having a pH of 1.5 to 2.4 is used.

More specifically, when the content of the aluminum phosphate monobasic is lower than 5 g/L, the mass per unit area of Al in the coating is not sufficient and strong barrier properties to the oxidization of the tin-plated layer is not obtained. When the content of the aluminum phosphate monobasic exceeds 200 g/L, the stability of the chemical conversion solution is deteriorated, a precipitate is formed in the chemical conversion solution and adheres to the surface of the tin-plated steel sheet, which causes a degradation of appearance and a reduction in paint adhesion. Moreover, when the pH of the chemical conversion solution is lower than 1.5, the deposition of the coating becomes difficult and a sufficient mass per unit area cannot be secured even when the treatment time is extremely prolonged to several 10 seconds. When the pH of the chemical conversion solution exceeds 2.4, the deposition of the coating rapidly occurs and thus the control of the mass per unit area becomes difficult.

Drying is preferably performed at a temperature lower than 60° C. This is because the chemical conversion coating formed by the manufacturing method can sufficiently suppress oxidization of the tin-plated layer even when the drying temperature is lower than 60° C. Thus, a particular heating facility is unnecessary. The drying temperature is the peak temperature of the steel sheet.

To allow the mass per unit area of P to reach 1.2 to 10 $mg/m^2$ in a short period of time, the amount of the aluminum phosphate monobasic is preferably adjusted to 60 to 120 g/L. To adjust the mass per unit area of P to 1.2 to 10 $mg/m^2$ at a high line speed, the cathodic electrolysis treatment is more preferable than the immersion treatment. It is more preferable to generate hydrogen gas by cathodic electrolysis to consume protons near the interface between the tin-plated surface and the chemical conversion solution to thereby forcibly increase the pH. Furthermore, to the chemical conversion solution, 1 to 20 g/L of orthophosphoric acid can be blended to adjust the pH or increase the reaction rate described below.

The pH of the chemical conversion solution can be adjusted by adding acid or alkali such as phosphoric acid, sulfuric acid or sodium hydroxide. To the chemical conversion solution, a promoter such as $FeCl_2$, $NiCl_2$, $FeSO_4$, $NiSO_4$, sodium chlorate, or nitrite salt; an etching agent such as a fluorine ion; and/or a surfactant such as sodium lauryl sulfate or acetylene glycol can be appropriately added. The temperature of the chemical conversion solution is preferably set to 70° C. or more. This is because when the temperature is set to 70° C. or more, the reaction rate increases with an increase in temperature and treatment at a higher line speed can be achieved. However, when the temperature is excessively high, the evaporation rate of moisture from the chemical conversion solution increases and the composition of the chemical conversion solution changes with time. Thus, the temperature of the chemical conversion solution is preferably 85° C. or lower.

As disclosed in JP '091, when a steel sheet is subjected to the immersion treatment or the cathodic electrolysis treatment in a chemical conversion solution containing tin ions and phosphate ions to form a single-layer chemical conversion coating, the steel sheet needs to be heated to 60 to 200° C. after the chemical conversion treatment. However, as in the case of our tin-plated steel sheet, when the second chemical conversion coating is formed on the first chemical conversion coating formed using the chemical conversion solution containing tin ions and phosphate ions by further performing immersing treatment in a chemical conversion solution containing aluminum phosphate monobasic or cathodic electrolysis in the chemical conversion solution, the steel sheet need not to be positively heated after the chemical conversion treatment. Thus, a heating facility is not necessary and the chemical conversion treatment can be performed at low cost.

As described above, considering that the current chromate treatment is usually performed at a line speed of 300 m/minute or more and the productivity is very high, it is preferable that new chemical conversion treatment in place of the chromate treatment can be performed at least at the current line speed. This is because when the treatment time is prolonged, the size of a treatment tank needs to be enlarged or the number of the tanks needs to be increased, which causes an increase in facility cost or the maintenance cost thereof. To perform the chemical conversion treatment at a line speed of 300 m/minute or more without reconstructing the facility, the treatment time is preferably set to 2.0 seconds or lower in total similarly as in the current chromate treatment. The treatment time is more preferably 1 second or lower.

When the immersion treatment or the cathodic electrolysis treatment is performed in the above-described chemical conversion solution, the treatment can be performed at the current line speed of 300 m/minute or more. The current density during the cathodic electrolysis treatment is preferably adjusted to 10 $A/dm^2$ or lower. This is because when the current density exceeds 10 $A/dm^2$, changes in the mass per unit area to changes in the current density become high, which makes it difficult to secure a stable mass per unit area. To form a chemical conversion coating, there is a method using application or anode electrolysis treatment in addition to the immersion treatment or the cathodic electrolysis treatment. However, the former treatment is likely to cause surface reaction unevenness, which makes it difficult to obtain uniform appearance and, in the latter method, the coating is likely to be deposited in a powder shape. Thus, degradation of appearance or degradation of paint adhesion is likely to occur. Thus, these methods are not preferable.

EXAMPLES

The raw material used to form a steel sheet was:

Steel sheet A: a low carbon cold-rolled steel sheet having a sheet thickness of 0.2 mm; or Steel sheet B: a steel sheet obtained by forming a nickel-plated layer on both surfaces of a low carbon cold-rolled steel sheet having a sheet thickness of 0.2 mm and a mass per unit area of 100 $mg/m^2$ using a Watts bath, and then annealing the steel sheet at 700° C. in an atmosphere containing 10% by volume $H_2$ and 90% by volume $N_2$ for diffusing nickel in the steel sheet. Then, an Sn layer was formed using a commercially-available tin plating bath with the mass per unit area of Sn shown in Table 3. Then, the Sn layers were reflowed at a temperature equal to or higher than the melting point of Sn, thereby forming a plated layer containing Sn of Fe—Sn layer/Sn layer on the steel sheet A and forming a plated layer containing Sn of Fe—Ni layer/Fe—Ni—Sn layer/Sn layer on the steel sheet B.

Next, to remove a surface Sn oxide film formed by reflowing, cathodic electrolysis was performed at a current density of 1 A/dm$^2$ in an aqueous 10 g/L sodium carbonate solution having a bath temperature of 50° C. Thereafter, immersion treatment was performed at a treatment time shown in Tables 1 and 2 or cathodic electrolysis treatment was performed at a current density and a treatment time shown in Tables 1 and 2 using a chemical conversion solution containing orthophosphoric acid and stannic chloride pentahydrate and having a temperature as shown in Tables 1 and 2. Then, wringing was performed by a wringer roll, followed by washing with water was performed. Subsequently, immersion treatment was performed at a treatment time shown in Tables 1 and 2 or cathodic electrolysis treatment was performed at a current density and a treatment time shown in Tables 1 and 2 using a chemical conversion solution containing orthophosphoric acid and aluminum phosphate monobasic and having a pH and a temperature as shown in Tables 1 and 2. Then, wringing was performed by a wringer roll, and then washing with water was performed. Then, the steel sheets were dried at room temperature using a general blower or dried using 70° C. hot air, thereby producing samples Nos. 1 to 22 of a tin-plated steel sheet having a first chemical conversion coating and a second chemical conversion coating. In the production thereof, the pH of the chemical conversion solutions shown in Table 1 and 2 was adjusted with acid or alkali.

Then, after each layer or coating was formed, the mass per unit area of Sn in the Sn-containing plating layer, the mass per unit area of P in the first chemical conversion coating, and the mass per unit area of P and the mass per unit area of Al in the second chemical conversion coating were measured by the above-described method. Moreover, the produced tin-plated steel sheets were evaluated for the appearance immediately after the production, the amount of the Sn oxide film and the appearance after long-term storage, the paint adhesion, and the corrosion resistance by the following methods.

Appearance immediately after production: The appearance of the tin-plated steel sheets immediately after the production was visually observed and evaluated as follows. Then, when evaluated as A or B, the appearance was good.

- A: Excellent appearance in which no powdery deposit is present on the surface and metallic luster is maintained
- B: Excellent appearance in which no powdery deposit is present on the surface but the surface is slightly whitish
- C: Uneven appearance in which a powdery deposit is locally present on the surface and the surface is slightly whitish
- D: Whitish appearance in which a large amount of powdery deposits is present on the surface Amount of Sn oxide film and appearance after long-term storage: The tin-plated steel sheets were stored for 10 days under an environment of 60° C. and a relative humidity of 70%. Then, the appearance was visually observed and also the amount of the Sn oxide film formed on the surface was evaluated as follows by electrolyzing with a current density of 25 uA/cm$^2$ in an electrolysis solution which was a 1/1000 N HBr solution, and determining the amount of electricity required for electrochemical reduction. When evaluated as A or B, the amount of Sn oxide film after long-term storage was small and the appearance was also good.

- A: Electric quantity for reduction of lower than 2 mC/cm$^2$, excellent appearance (better than that in the case of a chromate treated material)
- B: Electric quantity for reduction of 2 mC/cm$^2$ or more and lower than 3 mC/cm$^2$, excellent appearance (equivalent to that in the case of a chromate treated material)
- C: Electric quantity for reduction of 3 mC/cm$^2$ or more and lower than 5 mC/cm$^2$, slightly yellowish appearance
- D: Electric quantity for reduction of 5 mC/cm$^2$ or more, clear yellowish appearance Paint adhesion: An epoxy phenol paint was applied to the tin-plated steel sheets immediately after production so that the mass per unit area was 50 mg/dm$^2$, and then cured at 210° C. for 10 minutes. Subsequently, the two painted tin-plated steel sheets were laminated so that the coated surfaces face each other with a nylon adhesion film interposed therebetween, and pressure-bonded to each other under the bonding conditions of a pressure of $2.94\times10^5$ Pa, a temperature of 190° C., and a pressure-bonding time of 30 seconds. Then, the laminate was divided into test pieces having a width of 5 mm. Then, the test pieces were torn off using a tensile testing machine and evaluated as follows by measuring the strength. When evaluated as A or B, the paint adhesion was good. The same paint adhesion evaluation was also performed after the tin-plated steel sheets were stored for six months at a room temperature environment.

- A: 19.6 N (2 kgf) or more (equivalent to that in the case of a chromate treated material for welding cans)
- B: 3.92 N (0.4 kgf) or more and lower than 19.6 N (equivalent to that in the case of a chromate treated material for welding cans)
- C: 1.96 N (0.2 kgf) or more and lower than 3.92 N
- D: Lower than 1.96 N (0.2 kgf)

Corrosion resistance: An epoxy phenol paint was applied to the tin-plated steel sheets so that the mass per unit area was 50 mg/dm$^2$, and then cured at 210° C. for 10 minutes. Subsequently, the steel sheets were immersed in a commercially-available tomato juice at 60° C. for 10 days. Then, the stripping of the paint and the generation of rust were visually evaluated. When evaluated as A or B, the corrosion resistance was good.

- A: No stripping of the paint and no generation of rust
- B: No stripping of the paint but generation of very slight dot-like rust (equivalent to that in the case of a chromate treated material)
- C: No stripping of the paint but generation of slight rust
- D: Stripping of the paint and generation of rust The results are shown in Table 3. In all the samples Nos. 1 to 17 as our tin-plated steel sheets, the appearance immediately after the production and after long-term storage is good and the amount of the Sn oxide film after long-term storage is small, which shows that the samples have excellent paint adhesion and corrosion resistance.

TABLE 1

| | | Conditions for forming first chemical conversion coating | | | | | Conditions for forming second chemical conversion coating | | | | | | | | |
|---|---|---|---|---|---|---|---|---|---|---|---|---|---|---|---|
| | | Conversion solution | | | Cathodic electrolysis (immersion) | | Conversion solution | | | | Cathodic electrolysis (immersion) | | Drying | | |
| Sample No. | Raw material steel sheet | Amount of orthophosphoric acid (g/L) | Amount of stannic chloride pentahydrate (g/L) | Temperature (° C.) | Current density (A/dm$^2$) | Time (second) | Amount of orthophosphoric acid (g/L) | Amount of stannic chloride pentahydrate (g/L) | pH | Temperature (° C.) | Current density (A/dm$^2$) | Time (second) | Method | Peak sheet temperature (° C.) | Remarks |
| 1 | A | 6.0 | 0.7 | 60 | Immersion | 1.0 | 8.5 | 18.0 | 1.74 | 70 | 4 | 1.0 | Blower | Room temperature | Example |
| 2 | A | 6.0 | 2.7 | 60 | 5 | 1.0 | 4.2 | 18.0 | 1.97 | 70 | 4 | 1.0 | Blower | Room temperature | Example |
| 3 | A | 3.0 | 0.7 | 60 | Immersion | 0.5 | 3.0 | 18.0 | 2.08 | 70 | 4 | 1.0 | Blower | Room temperature | Example |
| 4 | A | 6.0 | 2.7 | 60 | 5 | 1.0 | 3.0 | 54.0 | 2.12 | 80 | 6 | 1.0 | Blower | Room temperature | Example |
| 5 | A | 3.0 | 0.7 | 60 | Immersion | 0.5 | 20.0 | 18.0 | 1.60 | 60 | 4 | 1.0 | Blower | Room temperature | Example |
| 6 | A | 6.0 | 0.7 | 60 | Immersion | 1.0 | 8.5 | 18.0 | 1.74 | 50 | 4 | 1.0 | Blower | Room temperature | Example |
| 7 | A | 3.0 | 0.7 | 60 | Immersion | 0.5 | 8.5 | 60.0 | 1.80 | 50 | 4 | 1.0 | Blower | Room temperature | Example |
| 8 | A | 6.0 | 2.7 | 60 | 3 | 1.0 | 8.5 | 80.0 | 1.80 | 50 | 4 | 1.0 | Blower | Room temperature | Example |
| 9 | A | 6.0 | 2.7 | 60 | 3 | 1.0 | 8.5 | 120.0 | 1.80 | 50 | 4 | 1.0 | Blower | Room temperature | Example |
| 10 | A | 6.0 | 2.7 | 60 | 3 | 1.0 | 8.5 | 200.0 | 1.80 | 50 | 4 | 1.0 | Blower | Room temperature | Example |
| 11 | A | 3.0 | 0.7 | 60 | Immersion | 0.5 | 1.0 | 60.0 | 2.00 | 50 | 4 | 0.5 | Blower | Room temperature | Example |
| 12 | A | 6.0 | 0.7 | 60 | Immersion | 1.0 | 8.5 | 60.0 | 1.80 | 50 | 4 | 1.0 | Hot air drying | 70 | Example |
| 13 | A | 6.0 | 0.7 | 60 | Immersion | 1.0 | 8.5 | 60.0 | 1.80 | 70 | Immersion | 1.0 | Blower | Room temperature | Example |
| 14 | A | 6.0 | 0.7 | 60 | Immersion | 1.0 | 8.5 | 18.0 | 1.74 | 70 | 5 | 1.0 | Blower | Room temperature | Example |
| 15 | B | 6.0 | 0.7 | 60 | Immersion | 1.0 | 8.5 | 18.0 | 1.74 | 70 | 5 | 1.0 | Blower | Room temperature | Example |
| 16 | A | 3.0 | 0.7 | 60 | Immersion | 0.5 | 8.5 | 18.0 | 1.74 | 70 | 3 | 1.0 | Blower | Room temperature | Example |
| 17 | B | 3.0 | 0.7 | 60 | Immersion | 0.5 | 8.5 | 18.0 | 1.74 | 70 | 3 | 1.0 | Blower | Room temperature | Example |

TABLE 2

| | | Conditions for forming first chemical conversion coating | | | | | Conditions for forming second chemical conversion coating | | | | | | | | |
|---|---|---|---|---|---|---|---|---|---|---|---|---|---|---|---|
| | | Conversion solution | | | | | Conversion solution | | | | | | | | |
| Sample No. | Raw material steel sheet | Amount of orthophosphoric acid (g/L) | Amount of stannic chloride pentahydrate (g/L) | Temperature (° C.) | Cathodic electrolysis (immersion) Current density (A/dm$^2$) | Cathodic electrolysis (immersion) Time (second) | Amount of orthophosphoric acid (g/L) | Amount of aluminum phosphate monobasic (g/L) | pH | Temperature (° C.) | Cathodic electrolysis (immersion) Current density (A/dm$^2$) | Cathodic electrolysis (immersion) Time (second) | Drying Method | Drying Peak sheet temperature (° C.) | Remarks |
| 18 | A | 6.0 | 0.7 | 60 | Immersion | 1.0 | 8.5 | 1.0 | 1.73 | 70 | 4 | 1.0 | Blower | Room temperature | Comparative example |
| 19 | A | 6.0 | 0.7 | 60 | Immersion | 1.0 | 8.5 | 250.0 | 2.00 | 70 | 4 | 2.0 | Blower | Room temperature | Comparative example |
| 20 | A | 6.0 | 0.7 | 60 | Immersion | 1.0 | 8.5 | 60.0 | 1.30 | 85 | 4 | 10.0 | Blower | Room temperature | Comparative example |
| 21 | A | 6.0 | 0.7 | 60 | Immersion | 1.0 | 8.5 | 60.0 | 2.50 | 50 | 4 | 0.5 | Blower | Room temperature | Comparative example |
| 22 | A | 6.0 | 2.7 | 60 | 5 | 1.0 | | | Not used | | | | Blower | Room temperature | Comparative example |

TABLE 3

| Sample No. | Sn-containing plating layer Mass per unit area of Sn (g/m$^2$) | First chemical conversion coating Mass per unit area of P (mg/m$^2$) | Second chemical conversion coating Mass per unit area of P (mg/m$^2$) | Second chemical conversion coating Mass per unit area of Al (mg/m$^2$) | Appearance immediately after production | Amount of Sn oxide film and appearance after long-term storage | Paint adhesion Immediately after production | Paint adhesion Six months later | Corrosion resistance | Remarks |
|---|---|---|---|---|---|---|---|---|---|---|
| 1 | 2.8 | 1.00 | 3.20 | 1.70 | A | A | B | B | A | Example |
| 2 | 2.8 | 8.50 | 4.50 | 2.39 | A | A | B | B | A | Example |
| 3 | 2.8 | 0.32 | 6.50 | 3.45 | A | A | B | B | A | Example |
| 4 | 2.8 | 8.50 | 9.50 | 5.13 | B | A | B | B | B | Example |
| 5 | 2.8 | 0.32 | 1.25 | 0.64 | A | B | B | B | A | Example |
| 6 | 2.8 | 1.00 | 2.50 | 1.38 | A | A | B | B | A | Example |
| 7 | 2.8 | 0.32 | 4.50 | 2.43 | A | A | B | B | A | Example |
| 8 | 2.8 | 6.50 | 6.00 | 3.30 | A | A | B | B | A | Example |
| 9 | 2.8 | 6.50 | 7.50 | 4.28 | A | A | B | B | A | Example |
| 10 | 2.8 | 6.50 | 7.60 | 4.41 | A | A | B | B | A | Example |
| 11 | 2.8 | 0.34 | 9.80 | 5.30 | A | A | B | B | A | Example |
| 12 | 2.8 | 1.00 | 4.50 | 2.43 | A | A | B | B | A | Example |
| 13 | 2.8 | 1.00 | 1.80 | 1.40 | A | A | B | B | A | Example |
| 14 | 1.1 | 1.00 | 3.30 | 1.75 | A | A | B | B | A | Example |
| 15 | 1.1 | 1.00 | 3.40 | 1.77 | A | A | B | B | A | Example |
| 16 | 0.1 | 0.32 | 3.60 | 1.94 | A | A | A | A | B | Example |
| 17 | 0.1 | 0.33 | 3.70 | 1.96 | A | A | A | A | B | Example |
| 18 | 2.8 | 1.00 | 2.50 | 0.22 | A | C | B | C | B | Comparative Example |
| 19 | 2.8 | 1.00 | 11.00 | 7.59 | D | A | D | D | C | Comparative Example |
| 20 | 2.8 | 1.00 | 1.00 | 0.52 | A | C | B | D | D | Comparative Example |
| 21 | 2.8 | 1.00 | 12.00 | 6.72 | C | A | C | C | C | Comparative Example |
| 22 | 2.8 | 8.50 | 0 | 0 | A | D | B | D | A | Comparative Example |

INDUSTRIAL APPLICABILITY

We have made it possible to manufacture, without using Cr, a tin-plated steel sheet that can suppress degradation of appearance and reduction in paint adhesion caused by oxidization of the tin-plated surface and that requires no special heating facility and thus can be subjected to chemical conversion treatment at low cost. Moreover, the chemical conversion coating of the tin-plated steel sheet can be formed at a high line speed of 300 m/minute or more similarly as in the case of the current chromate treatment. Therefore, our steel sheets and methods can greatly contribute to the industry.

The invention claimed is:

1. A method of manufacturing a tin-plated steel sheet comprising:

forming an Sn-containing plating layer on at least one surface of a steel sheet so that the mass per unit area of Sn is 0.05 to 20 g/m$^2$;

forming a first chemical conversion coating by immersing the steel sheet in a first chemical conversion solution containing tetravalent tin ions and phosphate ions or cathodically electrolyzing the steel sheet in the first chemical conversion solution;

forming a second chemical conversion coating after forming the first chemical conversion coating without drying the steel sheet by immersing the steel sheet in a second chemical conversion solution containing 5 to 200 g/L of aluminum phosphate monobasic and having a pH of 1.5 to 2.4 or cathodically electrolyzing the steel sheet in the second chemical conversion solution; and drying the steel sheet.

2. The method according to claim 1, wherein the drying is performed at a temperature lower than 60° C.

3. The method according to claim 1, further comprising removing excess first chemical conversion solution prior to forming the second conversion coating.

4. The method according to claim 1, further comprising washing prior to forming the second conversion coating.

5. The method according to claim 1, wherein the second chemical conversion solution contains 60 to 200 g/L of aluminum phosphate monobasic.

* * * * *